US006001217A

United States Patent [19]

Spatafora et al.

[11] Patent Number: 6,001,217

[45] Date of Patent: Dec. 14, 1999

[54] CUT AND SEAL UNIT FOR SHEET MATERIAL

[75] Inventors: Mario Spatafora; Fabrizio Tale' , both of Bologna, Italy

[73] Assignee: Azionaria Costruzioni Macchine Automatiche A.C.M.A. S.p.A., Bologna, Italy

[21] Appl. No.: 09/010,580

[22] Filed: Jan. 22, 1998

[30] Foreign Application Priority Data

Jan. 22, 1997 [IT] Italy ..... BO97A0027

[51] Int. Cl.[6] ..... B32B 31/18; B32B 31/08

[52] U.S. Cl. ..... 156/441.5; 156/515; 156/251; 156/292; 156/308.4

[58] Field of Search ..... 156/251, 292, 156/308.4, 515, 441.5; 53/477

[56] References Cited

U.S. PATENT DOCUMENTS 3,438,173 4/1969 Omori .
5,753,067 5/1998 Fukuda et al. .

FOREIGN PATENT DOCUMENTS 2 446 172 8/1980 France .

*Primary Examiner*—Sam Chaun Yao
*Attorney, Agent, or Firm*—Larson & Taylor

[57] ABSTRACT

A cut and seal unit for sheet material, wherein an actuating unit has a single powered input, and two identical output transmissions linked to each other and to the input; the two output transmissions are connected to respective cut and seal tools, which are moved by the actuating unit along respective substantially ellipsoidal trajectories on either side of a path of the sheet material extending through the two trajectories, and cooperate cyclically with each other at a cut and seal station along the path to transversely cut and seal the sheet material.

20 Claims, 3 Drawing Sheets

CUT AND SEAL UNIT FOR SHEET MATERIAL

BACKGROUND OF THE INVENTION

The present invention relates to a cut and seal unit for sheet material.

More specifically, the present invention may be used to advantage in the food packing industry, to which the following description refers purely by way of example.

In the food packing industry, so-called "form, fill and seal" packaging machines are used wherein an orderly succession of products, equally spaced inside a tubular package, is fed continuously along a path extending through a cut and seal station equipped with a cut and seal unit for transversely cutting and sealing the tubular package to form a succession of airtight pillow packs, each containing a respective product.

The cut and seal unit normally comprises at least two cut and seal tools movable along respective annular trajectories on either side of the path of the tubular package, and which cooperate cyclically with each other to cut and seal the tubular package; and, for each tool, a respective actuating device for moving the respective tool along the respective annular trajectory independently from the other actuating device.

More specifically, each actuating device is normally defined by a cam-tappet device comprising an annular cam, and a tappet roller positively engaging the cam and connected to the respective tool to move the tool along the respective trajectory and through the cut and seal station in time with the other tool.

Though fairly effective, the above known cut and seal unit involves several drawbacks impairing both reliability and performance of the unit. That is, friction between the tappet rollers and respective cams prevents the attainment of high steady-state operating speeds; friction-induced wear of the mechanical components and the different response to such wear by the two cam-tappet devices eventually result in differing operation of the tools and a gradual reduction in cut and seal precision and quality; and, finally, high operating speeds are also prevented by the high degree of acceleration and inertia of the unit itself.

SUMMARY OF THE INVENTION

It is an object of the present invention to provide a straightforward, low-cost cut and seal unit for sheet material, designed to eliminate the aforementioned drawbacks.

According to the present invention, there is provided a cut and seal unit for sheet material, the unit comprising two cut and seal tools cooperating cyclically with each other and movable along respective annular trajectories on either side of a given path of the sheet material, the path extending in a given traveling direction and through a cut and seal station for cutting and sealing the material; and actuating means for activating said two tools, and in turn comprising powered input means, and output means each connected to a respective said tool; the unit being characterized in that said input means are defined by a single powered element; said output means being identical, and being linked mutually and to said powered element to feed said two tools through said cut and seal station cyclically and in time with each other.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
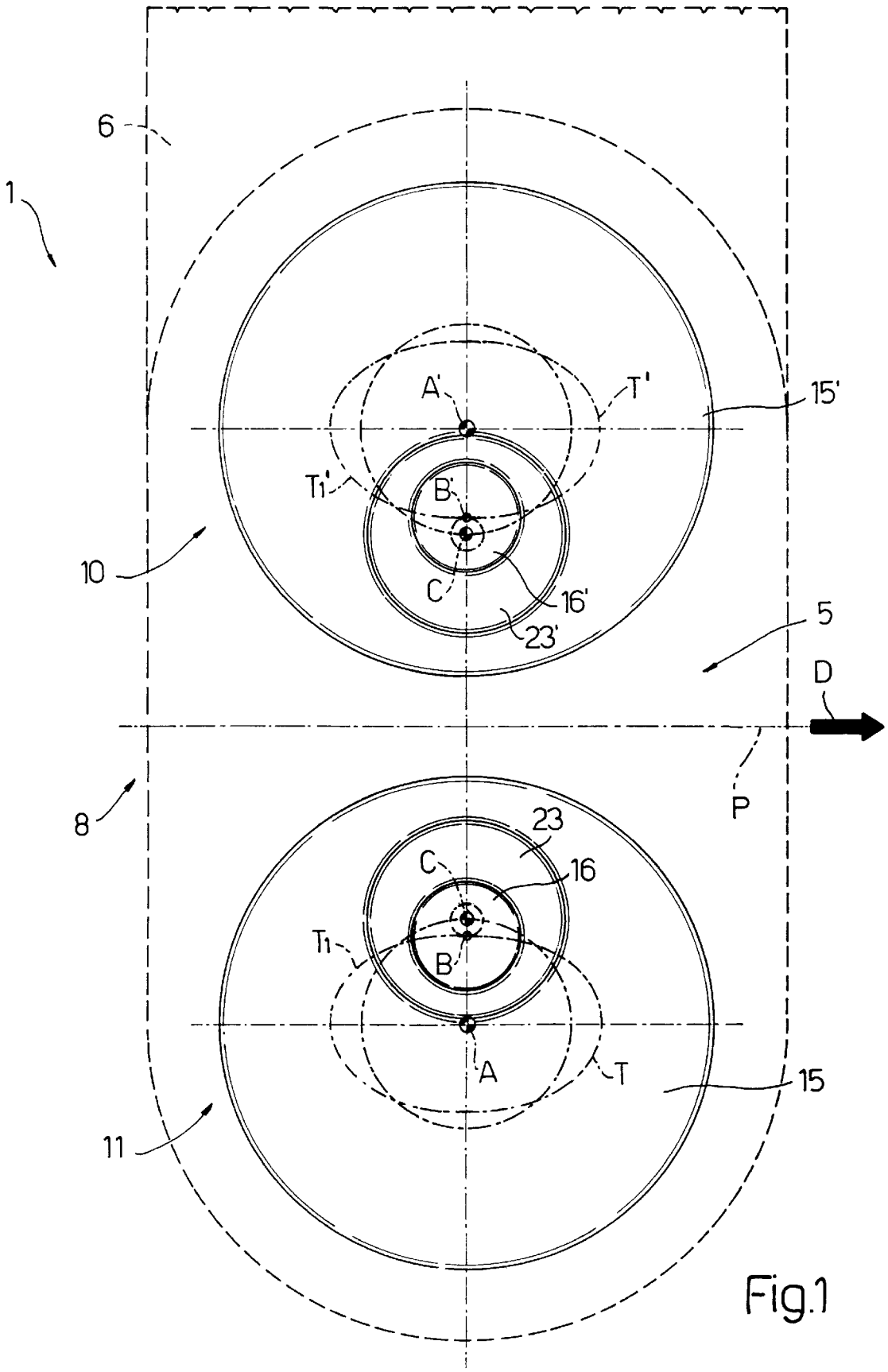
FIG. 1 shows a front view, with parts removed for clarity, of a preferred embodiment of the cut and seal unit according to the present invention.

Number 1 in the accompanying drawings indicates a cut and seal unit for packing products 2 inside respective airtight so-called "pillow" packs 3 formed by transversely cutting into segments a sheet material 4 defining a tubular package 4 fed axially at a given continuous speed V and in a given direction D along a path P extending through unit 1 at a cut and seal station 5.

Unit 1 comprises a frame 6 to the side of path P at station 5; two cut and seal tools 7 movable along respective annular work trajectories T on either side of path P, and cooperating cyclically with each other to form packs 3; and an actuating unit 8, which is fitted to frame 6, provides for moving tools 7 in time with each other along respective trajectories T, and shapes trajectories T substantially in the form of an ellipsoid about respective fixed axes A crosswise to direction D.

More specifically, in actual use, unit 8 moves tools 7' and 7 along respective trajectories T' and T in such a manner that, along respective mutually facing work portions T1' and T1 of trajectories T' and T, tools 7 contact package 4 at respective speeds V1 parallel to direction D and equal to speed V, and at respective speeds V2 crosswise to direction D, directed towards each other, and gradually decreasing to zero by the time tools 7 contact each other to cut and seal package 4; and in such a manner that, following mutual contact, tools 7 are withdrawn from each other, and from package 4 approaching station 5, at respective speeds V1 still equal to speed V, and at gradually increasing respective speeds V2 to gradually detach tools 7 from each other and, above all, from package 4. Along portions T1, tools 7 therefore travel along a substantially straight portion of path P, and mate so as to cooperate mutually along portions T1 in known manner not shown.

Figure 2:
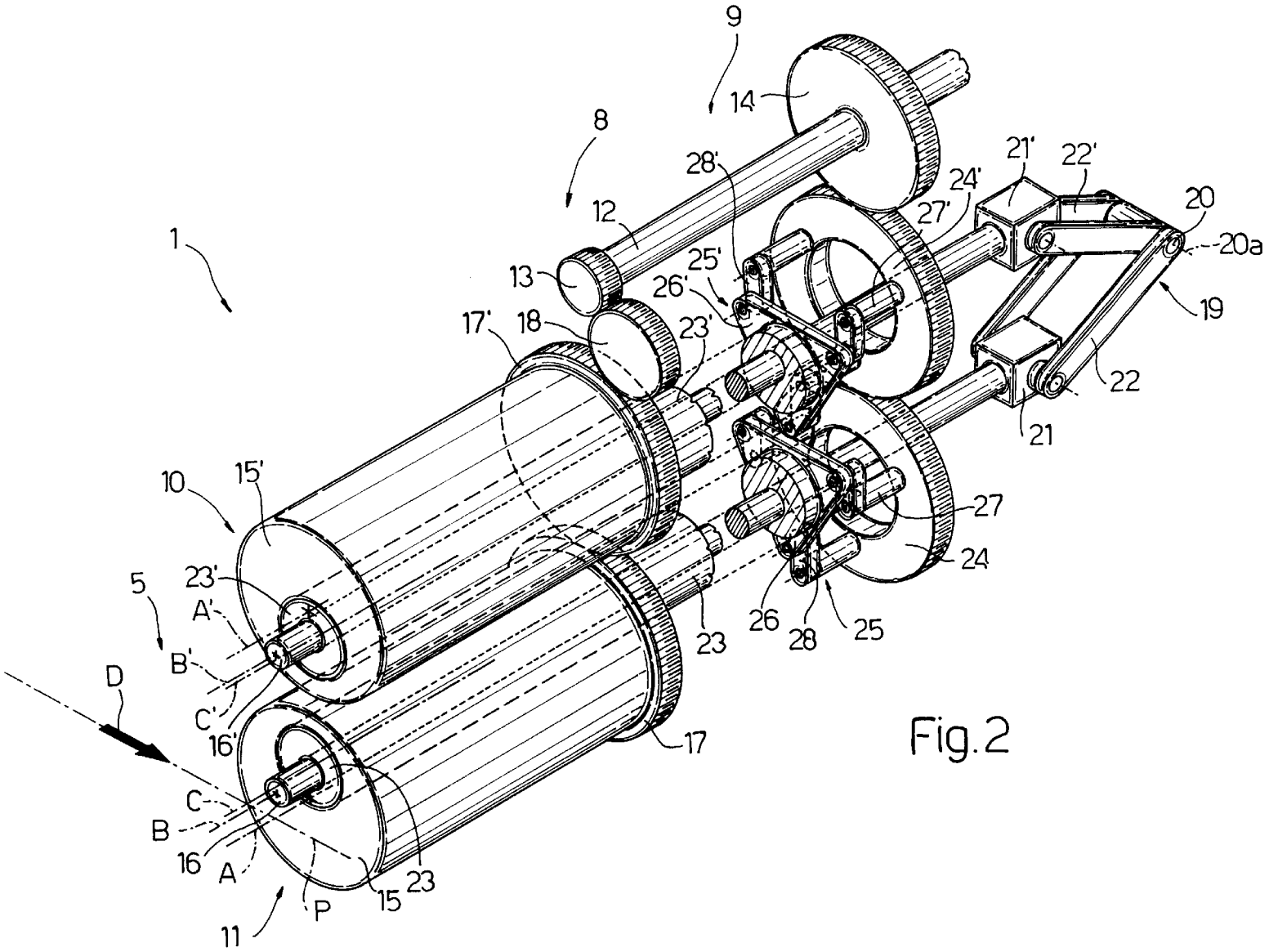
FIG. 2 shows a schematic view in perspective, with parts removed for clarity, of the FIG. 1 unit.

As shown in FIG. 2, unit 8 comprises an actuating device 9 defining a powered input of unit 8; and two structurally identical transmission devices 10 and 11 defining respective output means of unit 8 and linked to each other and to device 9 to move respective cut and seal tools 7 about respective axes A. More specifically, device 10 is located substantially above path P to rotate respective tool 7 (indicated 7') in a given direction about respective axis A (indicated A') and along respective trajectory T (indicated T'), and is powered directly by actuating device 9; whereas device 11 is located substantially below path P to rotate respective tool 7 about respective axis A in the opposite direction to tool 7', and is powered by device 10.

Device 9 comprises a powered shaft 12 rotated continuously about a respective axis parallel to axes A', A; a first gear 13 fitted to the end opposite the driven end of shaft 12; and a second gear 14 fitted to an intermediate portion of shaft 12, and having a given pitch diameter F1 equal to roughly three times the pitch diameter F2 of gear 13.

Devices 10 and 11 comprise respective drums 15' and 15 fitted to frame 6 so as to rotate about respective axes A' and A; and respective shafts 16' and 16 fitted through respective drums 15' and 15, coaxially with respective axes B' and B parallel to axes A' and A, and defining trajectories T' and T.

Drums 15' and 15 each comprise a fourth gear defined by respective gears 17' and 17 connected angularly to each other; gear 17' is connected to gear 13 via the interposition of an idle third gear 18 forming part of device 9; and shafts 16' and 16 support respective tools 7 at respective ends projecting axially outwards of respective drums 15' and 15, and are connected, at the opposite ends to those supporting tools 7, to a common articulated supporting joint 19 forming part of unit 8.

More specifically, joint 19 is connected to frame 6 so as to oscillate parallel to direction D, permits any movement of shafts 16' and 16 crosswise to respective axes B' and B, while maintaining shafts 16' and 16 parallel to themselves at all times, and comprises a central pin 20 having an axis 20*a* parallel to direction D, and two joints 21' and 21 connected in angularly and axially fixed manner to shafts 16' and 16 on one side, and connected in rotary manner to pin 20 on the opposite side by means of respective pairs of brackets 22' and 22, so as to oscillate about axis 20*a* and permit shafts 16' and 16 to move to and from each other.

Devices 10 and 11 also comprise respective tubular shafts 23' and 23 engaged in rotary manner by respective shafts 16' and 16, and which in turn are fitted inside respective drums 15' and 15 to rotate in the opposite direction to drums 15' and 15 about respective axes C' and C eccentric with respect to axes A', A and B', B, and are each connected angularly to a fifth gear defining respective gears 24' and 24 connected angularly to each other, and of which gear 24' is connected to gear 14. More specifically, gears 24' and 24 are supported for rotation by frame 6 coaxially with axes A' and A, rotate in the opposite direction to respective gears 17' and 17, and are defined by respective rings fitted through axially and in radially slack manner with shafts 16' and 16; and shafts 23' and 23 are connected angularly to gears 24' and 24 via the interposition of respective transverse joints 25' and 25 for rotating respective shafts 23' and 23 continuously about respective axes C' and C, and permitting transverse displacement of respective axes B' and B.

Besides forming part of respective device 10, 11, each joint 25', 25 comprises a flat, substantially triangular plate 26', 26 crosswise to respective axis C', C and connected integrally to the end of respective shaft 23', 23 opposite the end facing tool 7', 7. Each joint 25', 25 also comprises at least three pins 27', 27 fitted to respective gear 24', 24, equally spaced about respective axis A', A, and extending, parallel to axis C', C, from gear 24', 24 to respective plate 26', 26; and, for each pin 27', 27, a respective connecting rod 28', 28, which is interposed between respective pin 27', 27 and a respective vertex of plate 26', 26, is connected in rotary manner to respective plate 26', 26 and respective pin 27', 27, and is of a length L smaller than the radius R of gear 24', 24.

Figure 3:
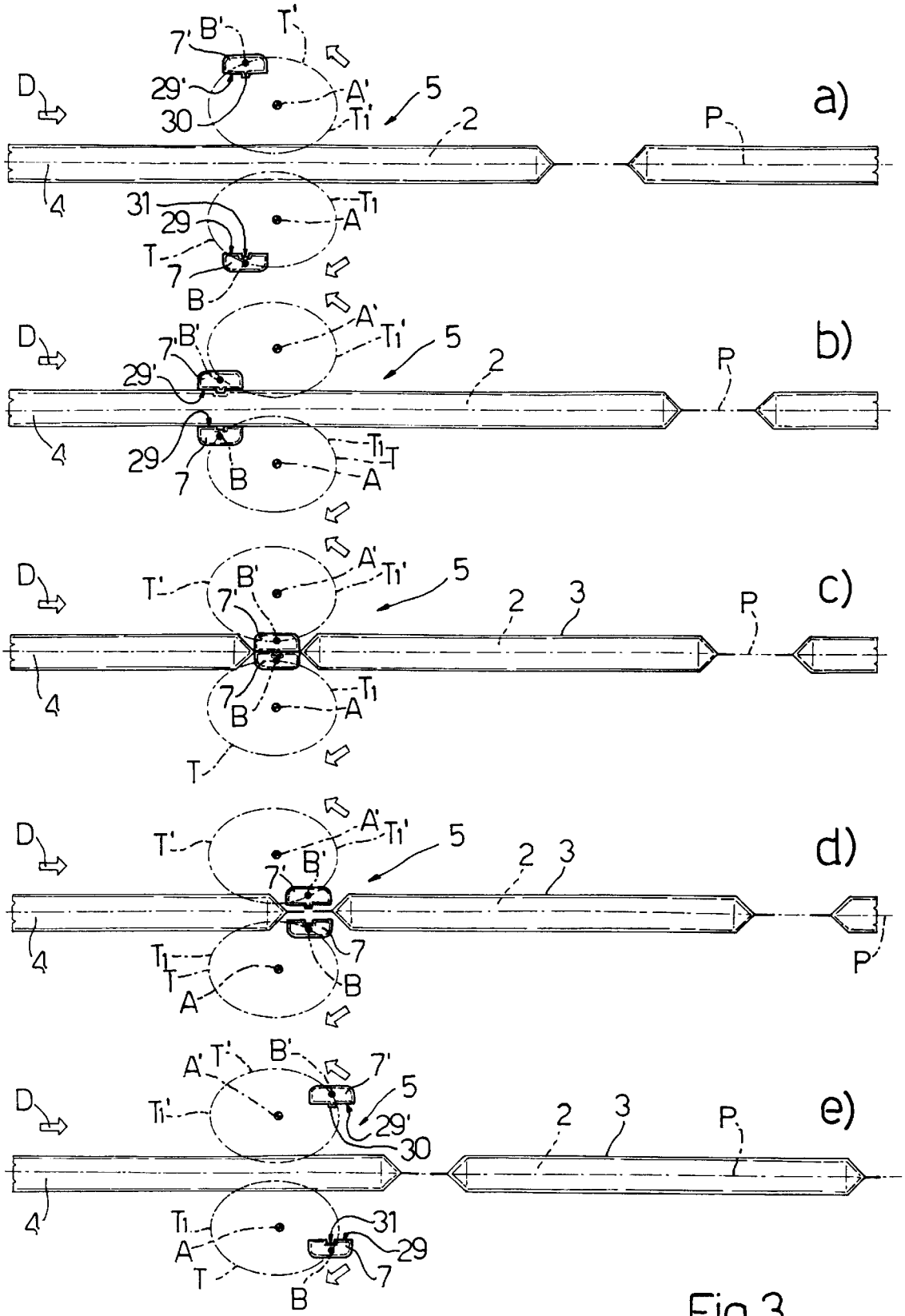
FIG. 3 shows, schematically, a succession of operating stages performed by the FIG. 1 unit.

Operation of unit 1 will first be described with reference to FIG. 3, which shows a series of operating positions, corresponding to respective operating stages, of cut and seal tools 7' and 7, and wherein tool 7' comprises a flat bottom heat-seal surface 29' from which extends a shaped longitudinal projection 30 parallel to axis A', and tool 7 comprises a flat top heat-seal surface 29 in which is formed a longitudinal groove 31 of the same shape as, and for receiving, projection 30 to transversely cut tubular package 4.

Tools 7' and 7 are rotated by unit 8 in opposite directions about respective axes A' and A (FIG. 3*a*) towards each other and towards tubular package 4 fed in known manner at speed V through station 5, and gradually contact package 4 (FIG. 3*b*) before being brought finally into the mutually contacting position (FIG. 3*c*). Upon tools 7' and 7 contacting package 4, this is heated until surfaces 29' and 29 are positioned directly facing each other to flatten and heat-seal the opposite surfaces of package 4, and until projection 30 engages groove 31 to detach from package 4 a pack 3 containing a respective product 2.

Once pack 3 is formed and simultaneously removed by a known pickup device (not shown), tools 7' and 7 are moved away from each other and from path P, and maintain, at least almost to the end of portion T1, a speed V1 substantially equal to speed V to prevent the incoming package 4 from colliding with tools 7' and 7.

Tools 7' and 7 are moved along respective trajectories T' and T by combining a first rotation of shafts 16' and 16 about respective axes A' and A, produced by rotating drums 15' and 15 in respective given opposite directions, and a second rotation of shafts 16' and 16 about respective axes C' and C, produced by rotating shafts 23' and 23 in opposite directions both to each other and to respective drums 15' and 15.

More specifically, powered shaft 12 of actuating device 9 rotates drums 15' and 15 via gears 13, 18, 17' and 17, and at the same time rotates shafts 23' and 23 via gears 14, 24', 24 and transverse joints 25' and 25; idle gear 18 causes gears 17' and 24' and therefore gears 17 and 24 to rotate in opposite directions about axes A' and A; and joints 25' and 25 provide for imparting the second rotation to shafts 23' and 23, while at the same time moving shafts 16', 16 and hence respective tools 7', 7 parallel to themselves.

That is, as shafts 23' and 23 rotate about respective axes C' and C, shafts 16' and 16 connected to frame 6 by joint 19 move in a direction crosswise to, as opposed to rotating about, respective axes B' and B, so as to move axes B' and B along trajectories T' and T; and connecting rods 28' and 28 connecting plates 26' and 26 to gears 24' and 24 rotate about respective pins 27' and 27 simultaneously with rotation of gears 24' and 24 about axes A' and A to permit transverse displacement of shafts 16' and 16.

We claim:

1. A cut and seal unit for sheet material, the unit comprising;

a first and a second cut and seal tools cooperating cyclically with each other and movable along respective first and second annular trajectories on either side of a given path of the sheet material, the path extending in a given traveling direction and through a cut and seal station for cutting and sealing the material;

an actuating means for activating said first and second cut and seal tools, and in turn comprising a powered input means, and (b) a first and a second output means connected to respective said first and second cut and seal tools;

wherein said input means is defined by a single powered element;

wherein said first and second output means a identical to each other and are linked mutually and to said input means to feed said first and second cut and seal tools through said cut and seal station cyclically and in time with each other; and wherein said first and second output means are defined by respective first and second output transmissions, each of said first and second output transmissions comprises (a) a supporting shaft supporting a respective one of said first and second cut and seal tools; (b) a first transport means for transporting the respective said supporting shaft in a first given rotation direction about a first axis of rotation; and (c) a second transport means for transporting the first transport means in a second given rotation direction about a second axis of rotation; whereby said first and second trajectories extend about respective said second axes of rotation.

2. A unit as claimed in claim 1, wherein said first and second given rotation directions are opposite rotation directions.

3. A unit as claimed in claim 1, wherein said first and second trajectories are substantially ellipsoidal.

4. A unit as claimed in claim 1, wherein said actuating means comprise an articulated joint connecting respective said supporting shafts; said articulated joint comprising respective connecting means connected to each respective said supporting shaft, and an articulated means connected to respective said connecting means to support the respective said supporting shafts parallel to each other by cooperating with said first and second transport means.

5. A unit as claimed in claim 4, wherein said articulated means comprise a pin parallel to said direction and movable parallel to said direction; and, for each respective said connecting means, at least one respective bracket connected for rotation to said pin and to the respective said connecting means.

6. A unit as claimed in claim 1, wherein said input means comprises a first and a second gear angularly integral with said powered element, and a third gear connected angularly to said first gear;

wherein each respective said second transport means comprises a respective drum rotating about the respective second axis of rotation, and a respective fourth gear angularly integral with the respective said drum;

wherein said respective fourth gears are connected angularly to each other; and wherein one of the respective said fourth gears is connected angularly to said third gear.

7. A unit as claimed in claim 6, wherein each respective said first transport means comprises (a) a respective tubular shaft coaxial with a respective third axis of rotation eccentric with respect to the respective said second axis of rotation, and engaged in rotary manner by the respective said supporting shaft; (b) a respective fifth gear rotating about the respective second axis of rotation; and (c) a respective joint connecting the respective said fifth gear and the respective said tubular shaft.

8. A unit as claimed in claim 7, wherein respective said fifth gears are connected angularly to each other, and rotate about the respective second axes of rotation in the opposite direction to that of the respective said fourth gears; one of the respective said fifth gears being connected angularly to said second gear.

9. A unit as claimed in claim 8, wherein each respective said joint comprises a plate angularly integral with the respective said tubular shaft; and a connecting rod means connecting the plate to the respective said fifth gear; each respective said supporting shaft being fitted for rotation through the respective said tubular shaft and the respective said plate.

10. A unit as claimed in claim 9, wherein each said connecting rod means comprises a given number of connecting rods equally spaced about the respective second axis of rotation and of a length substantially smaller than a radial dimension of the respective said fifth gear.

11. A unit as claimed in claim 10, wherein respective said connecting rods are mounted for rotation with respect to both the respective said plate and the respective said fifth gear.

12. A unit as claimed in claim 2, wherein said first and second trajectories are substantially ellipsoidal.

13. A unit as claimed in claim 12, wherein said actuating means comprise an articulated joint connecting respective said supporting shafts; said articulated joint comprising respective connecting means connected to each respective said supporting shaft, and an articulated means connected to respective said connecting means to support the respective said supporting shafts parallel to each other by cooperating with said first and second transport means.

14. A unit as claimed in claim 13, wherein said articulated means comprise a pin parallel to said direction and movable parallel to said direction; and, for each respective said connecting means, at least one respective bracket connected for rotation to said pin and to the respective said connecting means.

15. A unit as claimed in claim 14:

wherein said input means comprises a first and a second gear angularly integral with said powered element, and a third gear connected angularly to said first gear;

wherein each respective said second transport means comprises a respective drum rotating about the respective second axis of rotation, and a respective fourth gear angularly integral with the respective said drum;

wherein said respective fourth gears are connected angularly to each other; and wherein one of the respective said fourth gears is connected angularly to said third gear.

16. A unit as claimed in claim 15, wherein each respective said first transport means comprises (a) a respective tubular shaft coaxial with a respective third axis of rotation eccentric with respect to the respective said second axis of rotation, and engaged in rotary manner by the respective said supporting shaft; (b) a respective fifth gear rotating about the respective second axis of rotation; and (c) a respective joint connecting the respective said fifth gear and the respective said tubular shaft.

17. A unit as claimed in claim 16, wherein respective said fifth gears are connected angularly to each other, and rotate about the respective second axes of rotation in the opposite direction to that of the respective said fourth gears; one of the respective said fifth gears being connected angularly to said second gear.

18. A unit as claimed in claim 17, wherein each respective said joint comprises a plate angularly integral with the respective said tubular shaft; and a connecting rod means connecting the plate to the respective said fifth gear; each respective said supporting shaft being fitted for rotation through the respective said tubular shaft and the respective said plate.

19. A unit as claimed in claim 18, wherein each said connecting rod means comprises a given number of connecting rods equally spaced about the respective second axis of rotation and of a length substantially smaller than a radial dimension of the respective said fifth gear.

20. A unit as claimed in claim 19, wherein respective said connecting rods are mounted for rotation with respect to both the respective said plate and the respective said fifth gear.

* * * * *